US010548207B2

(12) United States Patent
Buerker et al.

(10) Patent No.: US 10,548,207 B2
(45) Date of Patent: Jan. 28, 2020

(54) METHOD AND APPARATUS FOR ELECTROSTATICALLY DISCHARGING A PRIMARY PACKAGING CONTAINER MADE OF PLASTICS

(71) Applicant: Hoffmann-La Roche Inc., Little Falls, NJ (US)

(72) Inventors: Tatjana Buerker, Muensing (DE); Christian Haase, Lengenwang (DE); Klaus Reichert, Oberhausen (DE)

(73) Assignee: Hoffmann-La Roche Inc., Little Falls, NJ (US)

( * ) Notice: Subject to any disclaimer, the term of this patent is extended or adjusted under 35 U.S.C. 154(b) by 313 days.

(21) Appl. No.: 15/720,241

(22) Filed: Sep. 29, 2017

(65) Prior Publication Data

US 2018/0027639 A1 Jan. 25, 2018

Related U.S. Application Data

(63) Continuation of application No. PCT/EP2016/056599, filed on Mar. 24, 2016.

(30) Foreign Application Priority Data

Mar. 31, 2015 (EP) ..... 15161877

(51) Int. Cl.
*H05F 3/00* (2006.01)
*H05F 3/06* (2006.01)

(52) U.S. Cl.
CPC ..... *H05F 3/06* (2013.01)

(58) Field of Classification Search
None
See application file for complete search history.

(56) References Cited

U.S. PATENT DOCUMENTS 4,701,973 A 10/1987 McBrady et al.
4,709,297 A * 11/1987 Walther ..... H05K 13/0084 206/719

(Continued)

FOREIGN PATENT DOCUMENTS

EP 2269943 A2 1/2011

*Primary Examiner* — Stephen W Jackson
(74) *Attorney, Agent, or Firm* — Jonathan P. Aumais

(57) ABSTRACT

A method and an apparatus (100) for electrostatically discharging a primary packaging container (102) made of plastics are disclosed. The method comprises moving a primary packaging container (102) to be electrostatically discharged so as to pass at least one electrode (104, 106, 108), applying an alternating voltage to the electrode (104, 106, 108) so as to generate ionized air in a vicinity of the electrode (104, 106, 108), and rotating the primary packaging container (102) in the vicinity of the electrode (104, 106, 108) so as to be contacted by the ionized air. The apparatus (100) comprises at least one electrode (104, 106, 108) adapted to generate ionized air in a vicinity of the electrode (104, 106, 108) and a moving path (128) for moving a primary packaging container (102) to be electrostatically discharged, wherein the moving path (128) is formed such that the primary packaging container (102) is adapted to pass the electrode (104, 106, 108) and to be rotated in the vicinity of the electrode (104, 106, 108) so as to be contacted by the ionized air.

18 Claims, 2 Drawing Sheets

(56) References Cited

U.S. PATENT DOCUMENTS

Figure 1:
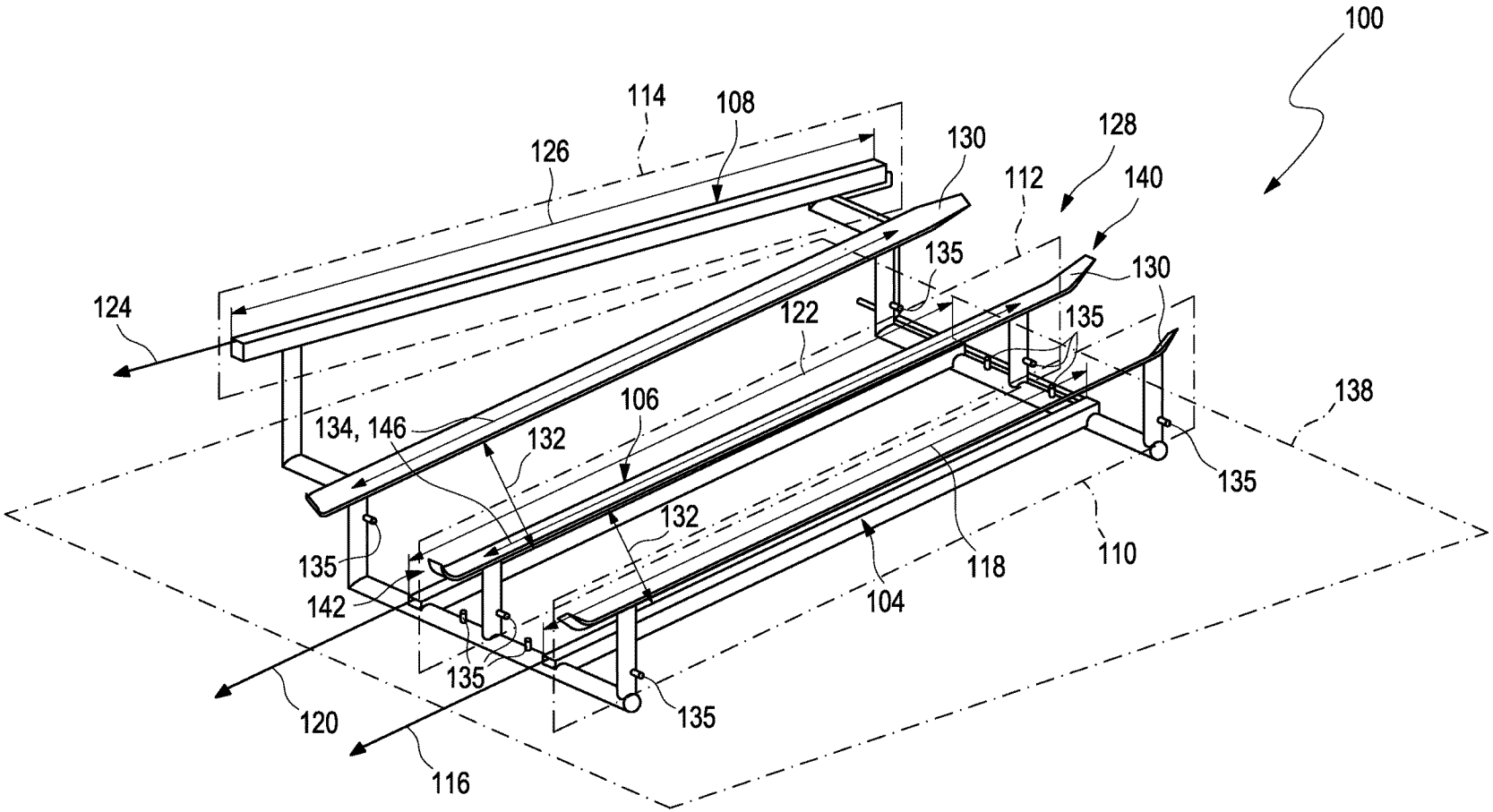

| | | | | |
|---|---|---|---|---|
| 4,883,542 | A * | 11/1989 | Voneiff | B08B 5/00 134/21 |
| 5,265,298 | A * | 11/1993 | Young | B08B 5/023 15/1.51 |
| 2004/0131496 | A1 | 7/2004 | Goetzelmann et al. | |
| 2007/0240784 | A1 | 10/2007 | Wu et al. | |
| 2011/0100401 | A1 | 5/2011 | Fiorentini | |

* cited by examiner

METHOD AND APPARATUS FOR ELECTROSTATICALLY DISCHARGING A PRIMARY PACKAGING CONTAINER MADE OF PLASTICS

CROSS REFERENCE TO RELATED APPLICATIONS

This application is a continuation of and claims priority to International Application No. PCT/EP2016/056599, filed Mar. 24, 2016, which claims priority to European Application No. 15161877.4, filed Mar. 31, 2015, both of which applications are hereby incorporated by reference in their entirety.

FIELD OF THE INVENTION

The present invention relates to a method and to an apparatus for electrostatically discharging a primary packaging container made of plastics. A primary packaging container in the sense of the present invention is a container which is adapted to directly come into contact with e.g. pharmaceuticals or food and which is made of plastics. Particularly but not exclusively, a primary packaging container in the sense of the present invention may be made of fluorinated ethylene propylene, polytetrafluoroethylene or both. Needless to say, a primary packaging container in the sense of the present invention may be made of other plastics than those mentioned such as polyethylene terephthalate or polypropylene.

Related Art

The production of food and pharmaceuticals has to comply with strict hygienic provisions. Particularly, pharmaceuticals are produced in clean rooms. In such clean rooms, the concentration of germs and particles are monitored. For this reason, measurements are taken in order to limit the concentration of particles. For example, air filters are used in order to decrease the particle concentration in the air within the clean room in order to reduce the risk of contamination of the product to be filled into the primary packaging container.

US 2011/0100401 A1 describes a method and a device for removing contaminating particles from containers.

EP 2 269 943 A2 describes a method of eliminating static charge from a resin vessel.

U.S. Pat. No. 4,701,973 A describes a bottle duster.

Problem to be Solved

However, primary packaging containers made of plastics may be electrostatically charged which is caused by the so called triboelectric effect. Particularly, tetrafluoroethylene comprises the characteristics to bond electrons based on the comparable high electronegativity of the fluorine atoms present in covalent bonds within the plastics. Such electrostatically charged primary packaging container act like a magnet onto particles and attract particles present in the air. Even particles, which are initially electrically neutral, are attracted as these are re-arranged in the vicinity of electrostatical fields so as to form a dipole. The electrostatical forces acting onto the particles are strong enough such that even standardized and validated cleaning procedures of the primary packaging containers such as washers and bottle rinsing machines may not remove the particles adhering to the primary packaging containers in any case. Such adhering particles may contaminate the products filled into the primary packaging container.

It is therefore an objective of the present invention to provide a method and an apparatus for electrostatically discharging primary packaging containers.

SUMMARY OF THE INVENTION

This problem is solved by a method and a device for electrostatically discharging primary packaging containers with the features of the independent claims. Preferred embodiments, which might be realized in an isolated fashion or in any arbitrary combination are listed in the dependent claims.

As used in the following, the terms "have", "comprise" or "include" or any arbitrary grammatical variations thereof are used in a non-exclusive way. Thus, these terms may both refer to a situation in which, besides the feature introduced by these terms, no further features are present in the entity described in this context and to a situation in which one or more further features are present. As an example, the expressions "A has B", "A comprises B" and "A includes B" may both refer to a situation in which, besides B, no other element is present in A (i.e. a situation in which A solely and exclusively consists of B) and to a situation in which, besides B, one or more further elements are present in entity A, such as element C, elements C and D or even further elements.

Further, it shall be noted that the terms "at least one", "one or more" or similar expressions indicating that a feature or element may be present once or more than once typically will be used only once when introducing the respective feature or element. In the following, in most cases, when referring to the respective feature or element, the expressions "at least one" or "one or more" will not be repeated, non-withstanding the fact that the respective feature or element may be present once or more than once.

Further, as used in the following, the terms "preferably", "more preferably", "particularly", "more particularly", "specifically", "more specifically" or similar terms are used in conjunction with optional features, without restricting alternative possibilities. Thus, features introduced by these terms are optional features and are not intended to restrict the scope of the claims in any way. The invention may, as the skilled person will recognize, be performed by using alternative features. Similarly, features introduced by "in an embodiment of the invention" or similar expressions are intended to be optional features, without any restriction regarding alternative embodiments of the invention, without any restrictions regarding the scope of the invention and without any restriction regarding the possibility of combining the features introduced in such way with other optional or non-optional features of the invention.

According to the present invention, a method for electrostatically discharging a primary packaging container made of plastics is disclosed. A primary packaging container in the sense of the present invention is a container which is adapted to directly come into contact with pharmaceuticals or food and which is made of plastics. Particularly but not exclusively, a primary packaging container in the sense of the present invention may be made of fluorinated ethylene propylene, polytetrafluoroethylene or both. Needless to say, a primary packaging container in the sense of the present invention may be made of other plastics than those mentioned such as polyethylene terephthalate or polypropylene.

Such a primary packaging container may be a bottle made of plastics such as fluorinated ethylene propylene, polytetrafluoroethylene or both.

The method comprises the following steps:

moving a primary packaging container to be electrostatically discharged so as to pass at least one electrode, applying an alternating voltage at the electrode so as to generate ionized air in a vicinity of the electrode, and rotating the primary packaging container in the vicinity of the electrode so as to be contacted by the ionized air.

The term "pass" in connection with the movement of the primary packaging container relative to the electrode is to be understood in that the primary packaging container is moved along the electrode without contacting the same. The main component of the movement of the primary packaging container is parallel to a direction in which the electrode mainly extends, i.e. a longitudinal direction of the electrode.

The alternating voltage is applied with an amount suitable to ionize air and more particularly ionize oxygen molecules and nitrogen molecules. For example, the amount of the alternating voltage may be in a range of 4 kV to 12 kV such as 8 kV. The frequency of the alternating voltage may be 50 Hz.

As such, the term "vicinity" of the electrode is to be understood in that a portion of air in the surroundings of the electrode is ionized, wherein the size of this portion depends mainly on the amount of alternating voltage. That is, the higher the alternating voltage the larger is the portion of ionized air in the vicinity of the electrode.

The primary packaging container is rotated when entering the vicinity of the electrode such that the primary packaging container comes into contact with ionized air. A negative voltage causes electrons to be transferred to oxygen molecules. A positive voltage causes electrons to be withdrawn from nitrogen molecules. If such nitrogen molecules having a positive charge move in the vicinity of a primary packaging container having a negative electrostatical charge, electrons are transferred from the surface of the primary packaging container to the nitrogen molecules having a positive charge. Thereby, the electrostatic charge of the primary packaging container is reduced and the electrostatic adhering force acting on particles is reduced. Accordingly, the term "electrostatically discharging" is to be understood in that it does not necessarily mean a total discharging to an amount of 0 V but means a reduction below a threshold at which particles adhere to a primary packaging container made of plastics. In order to ensure a sufficient quality of the discharging process, it is preferred to reduce the charge of the primary packaging to an amount significantly below this threshold. For example, the charge of the primary packaging container is reduced to an amount of −200 V or less. Thereby, the method according to the present invention allows to provide a method for electrostatically discharging primary packaging containers made of plastics which is automatable and may be carried out according to predefined standard conditions. In other words, the method according to the present invention allows to electrostatically discharge primary packaging containers made of plastics within a predetermined quality range such that several primary packaging containers may be electrostatically discharged to substantially identical amounts.

The primary packaging container may be moved so as to pass the electrode with a predetermined distance to the electrode. Thus, the primary packaging container does not contact the electrode while being effectively discharged in the vicinity thereof.

The electrode may comprise a predetermined length, wherein the predetermined distance to the electrode is constant over the predetermined length. Thereby, the discharging effect is constant over the length of the electrode. For example, the electrode extends in a longitudinal direction, wherein the primary packaging container is moved parallel to the longitudinal direction.

The primary packaging container may comprise a longitudinal axis, wherein the primary packaging container is rotated at least one complete rotation around the longitudinal axis in the vicinity of the electrode while being contacted by the ionized air. Thereby, it is ensured that the complete outer surface of the primary packaging container around the longitudinal axis is discharged.

The primary packaging container may be moved so as to pass a plurality of electrodes, wherein an alternating voltage is applied to each of the plurality of the electrodes so as to generate ionized air in the vicinity of the plurality of electrodes. Thus, the discharging effectivity may be improved.

The electrodes may be located within planes which are parallel to one another. Thereby, a good distribution of ionized air is achieved which further improves the discharging effectivity.

The planes may be evenly spaced apart from one another. Thereby, an even distribution of ionized air is achieved which further improves the discharging effectivity.

At least one of the electrodes may be arranged such that the primary packaging container passes the at least one electrode with a complete cross-sectional area perpendicular to the longitudinal axis of the primary packaging container. Thereby, it may be ensured that the bottom and/or top of the primary packaging container may be discharged.

For example, the primary packaging container may comprise a closure, wherein the primary packaging container is moved such that the closure faces the one electrode. Thereby, it is ensured that the primary packaging container is discharged at the closure and at the adjacent portions thereof.

The primary packaging container may be moved along an inclined path. The term "inclined path" is to be understood in that the path comprises a deviation from a plane perpendicular to the direction of gravity. Thereby, the primary packaging container may be moved by means of gravity. Thus, a driving means such as motor for moving the primary packaging container may be omitted.

According to the present invention, an apparatus for electrostatically discharging a primary packaging container made of plastics. The apparatus comprises at least one electrode adapted to generate ionized air in a vicinity of the electrode. If an alternating voltage is applied to the electrode with a sufficient amount, the electrode causes air to be ionized in its vicinity. The apparatus further comprises a moving path for moving a primary packaging container to be electrostatically discharged. The moving path is formed such that the primary packaging container is adapted to pass the electrode and to be rotated in the vicinity of the electrode so as to be contacted by the ionized air. In other words, the primary packaging container may be moved on the moving path and is discharged near the electrode without being contacted by the electrode. Thereby, the apparatus according to the present invention allows to electrostatically discharge primary packaging containers made of plastics in an automatable manner and according to predefined standard conditions. In other words, the apparatus according to the present invention allows to electrostatically discharge primary packaging containers made of plastics within a predetermined quality range in an automatable manner such that several primary packaging containers may be electrostatically discharged to substantially identical amounts.

The moving path may comprise rails on which the primary packaging container is moveable. Thereby, the primary packaging container may be guided and the ionized air may reliably contact the primary packaging container as the ionized air may move between the rails and is not obstructed thereby. Alternatively, the moving path may comprise other guiding elements than rails such as rollers or the like.

The rails may be arranged with a predetermined distance to the electrode. Thus, the primary packaging container does not contact the electrode while being effectively discharged in the vicinity thereof.

The rails may comprise a portion which is arranged with a constant distance to the electrode over a length of the electrode. Thereby, the discharging effect is constant over the length of the electrode. For example, the electrode extends in a longitudinal direction, wherein the primary packaging container is moved parallel to the longitudinal direction.

The distance may be variable. Thereby, the distance may be adapted to the size of the primary packaging container. For example, the bigger the primary packaging container is the smaller the distance may be.

The electrode may extend in a longitudinal direction, wherein the portion of the rails is parallel to the longitudinal direction. Thereby, the discharging effect is constant over the length of the electrode.

The primary packaging container may comprise a longitudinal axis, wherein the moving path is formed such that the primary packaging container is rotatable at least one complete rotation around the longitudinal axis in the portion. Thereby, it is ensured that the complete outer surface of the primary packaging container around the longitudinal axis is discharged.

The apparatus may further comprise a plurality of electrodes. In this case, each of the plurality of electrodes is adapted to generate ionized air. Further, the moving path is formed such that the primary packaging container is adapted to pass each of the electrodes and to be rotated in the vicinity of the electrodes. Thus, the even bigger primary packaging containers may be effectively discharged by this construction.

The electrodes may be located within planes which are parallel to one another. Thus, the discharging quality may be improved.

The planes may be evenly spaced apart from one another. Thus, an even discharging is possible with bigger primary packaging containers.

At least one of the electrodes may be arranged such that the primary packaging container is adapted to pass the at least one electrode with a complete cross-sectional area perpendicular to the longitudinal axis of the primary packaging container. Thus, a bottom and/or top of the primary packaging container may be discharged.

The primary packaging container may comprise a closure, wherein the moving path is formed such the primary packaging container is adapted to be moved such that the closure faces the one electrode. Thus, the primary packaging container may be discharged at the closure and the adjacent portions thereof.

The moving path may comprise an inclination. The term "inclination" is to be understood in that the path comprises a deviation from a plane perpendicular to the direction of gravity. Thereby, the moving path may be formed such that the primary packaging container may be moved by means of gravity. Thus, a driving means such as motor for moving the primary packaging container may be omitted.

Summarizing the findings of the present invention, the following embodiments are preferred:

Embodiment 1

A method for electrostatically discharging a primary packaging container made of plastics, comprising moving a primary packaging container to be electrostatically discharged so as to pass at least one electrode, applying an alternating voltage to the electrode so as to generate ionized air in a vicinity of the electrode, and rotating the primary packaging container in the vicinity of the electrode so as to be contacted by the ionized air.

Embodiment 2

The method according to the preceding embodiment, wherein the primary packaging container is moved so as to pass the electrode with a predetermined distance to the electrode.

Embodiment 3

The method according to the preceding embodiment, wherein the electrode comprises a predetermined length, wherein the predetermined distance to the electrode is constant over the predetermined length.

Embodiment 4

The method according to the preceding embodiment, wherein the electrode extends in a longitudinal direction, wherein the primary packaging container is moved parallel to the longitudinal direction.

Embodiment 5

The method according to any preceding embodiment, wherein the primary packaging container comprises a longitudinal axis, wherein the primary packaging container is rotated at least one complete rotation around the longitudinal axis in the vicinity of the electrode while being contacted by the ionized air.

Embodiment 6

The method according to any preceding embodiment, wherein the primary packaging container is moved so as to pass a plurality of electrodes, wherein to each of the plurality of the electrodes an alternating voltage is applied so as to generate ionized air in the vicinity of the plurality of electrodes.

Embodiment 7

The method according to the preceding embodiment, wherein the electrodes are located within planes which are parallel to one another.

Embodiment 8

The method according to the preceding embodiment, wherein the planes are evenly spaced apart from one another.

Embodiment 9

The method according to any of the three preceding embodiments, wherein at least one of the electrodes is arranged such that the primary packaging container passes the at least one electrode with a complete cross-sectional area perpendicular to the longitudinal axis of the primary packaging container.

Embodiment 10

The method according to the preceding embodiment, wherein the primary packaging container comprises a closure, wherein the primary packaging container is moved such that the closure faces the at least one electrode.

Embodiment 11

The method according to any preceding embodiment, wherein the primary packaging container is moved along an inclined path.

Embodiment 12

The method according to any preceding embodiment, wherein the primary packaging container is moved by means of gravity.

Embodiment 13

The method according to any preceding embodiment, wherein the primary packaging container is made of fluorinated ethylene propylene.

Embodiment 14

An apparatus for electrostatically discharging a primary packaging container made of plastics, comprising at least one electrode adapted to generate ionized air in a vicinity of the electrode and a moving path for moving a primary packaging container to be electrostatically discharged, wherein the moving path is formed such that the primary packaging container is adapted to pass the electrode and to be rotated in the vicinity of the electrode so as to be contacted by the ionized air.

Embodiment 15

The apparatus according to the preceding embodiment, wherein the moving path comprises rails on which the primary packaging container is moveable.

Embodiment 16

The apparatus according to the preceding embodiment, wherein the rails are arranged with a predetermined distance to the electrode.

Embodiment 17

The apparatus according to the preceding embodiment, wherein the rails comprise a portion which is arranged with a constant distance to the electrode over a length of the electrode.

Embodiment 18

The apparatus according to the preceding embodiment, wherein the distance is variable.

Embodiment 19

The apparatus according to any of the two preceding embodiments, wherein the electrode extends in a longitudinal direction, wherein the portion of the rails is parallel to the longitudinal direction.

Embodiment 20

The apparatus according to the preceding embodiment, wherein the primary packaging container comprises a longitudinal axis, wherein the moving path is formed such that the primary packaging container is rotatable at least one complete rotation around the longitudinal axis in the portion.

Embodiment 21

The apparatus according to any one of embodiments 14 to 20, further comprising a plurality of electrodes, wherein each of the plurality of electrodes is adapted to generate ionized air, wherein the moving path is formed such that the primary packaging container is adapted to pass each of the electrodes and to be rotated in the vicinity of the electrodes.

Embodiment 22

The apparatus according to the preceding embodiment, wherein the electrodes are located within planes which are parallel to one another.

Embodiment 23

The apparatus according to the preceding embodiment, wherein the planes are evenly spaced apart from one another.

Embodiment 24

The apparatus according to any of the three preceding embodiments, wherein at least one of the electrodes is arranged such that the primary packaging container is adapted to pass the at least one electrode with a complete cross-sectional area perpendicular to the longitudinal axis of the primary packaging container.

Embodiment 25

The apparatus according to the preceding embodiment, wherein the primary packaging container comprises a closure, wherein the moving path is formed such the primary packaging container is adapted to be moved such that the closure faces the at least one electrode.

Embodiment 26

The apparatus according to any one of embodiments 14 to 25, wherein the moving path comprises an inclination.

Embodiment 27

The apparatus according to any one of embodiments 14 to 26, wherein the moving path is formed such that the primary packaging container is moveable by means of gravity.

SHORT DESCRIPTION OF THE FIGURES

Further optional features and embodiments of the invention will be disclosed in more detail in the subsequent description of preferred embodiments, preferably in conjunction with the dependent claims. Therein, the respective optional features may be realized in an isolated fashion as well as in any arbitrary feasible combination, as the skilled person will realize. The scope of the invention is not restricted by the preferred embodiments. The embodiments are schematically depicted in the Figures. Therein, identical reference numbers in these Figures refer to identical or functionally comparable elements.

Figure 2:
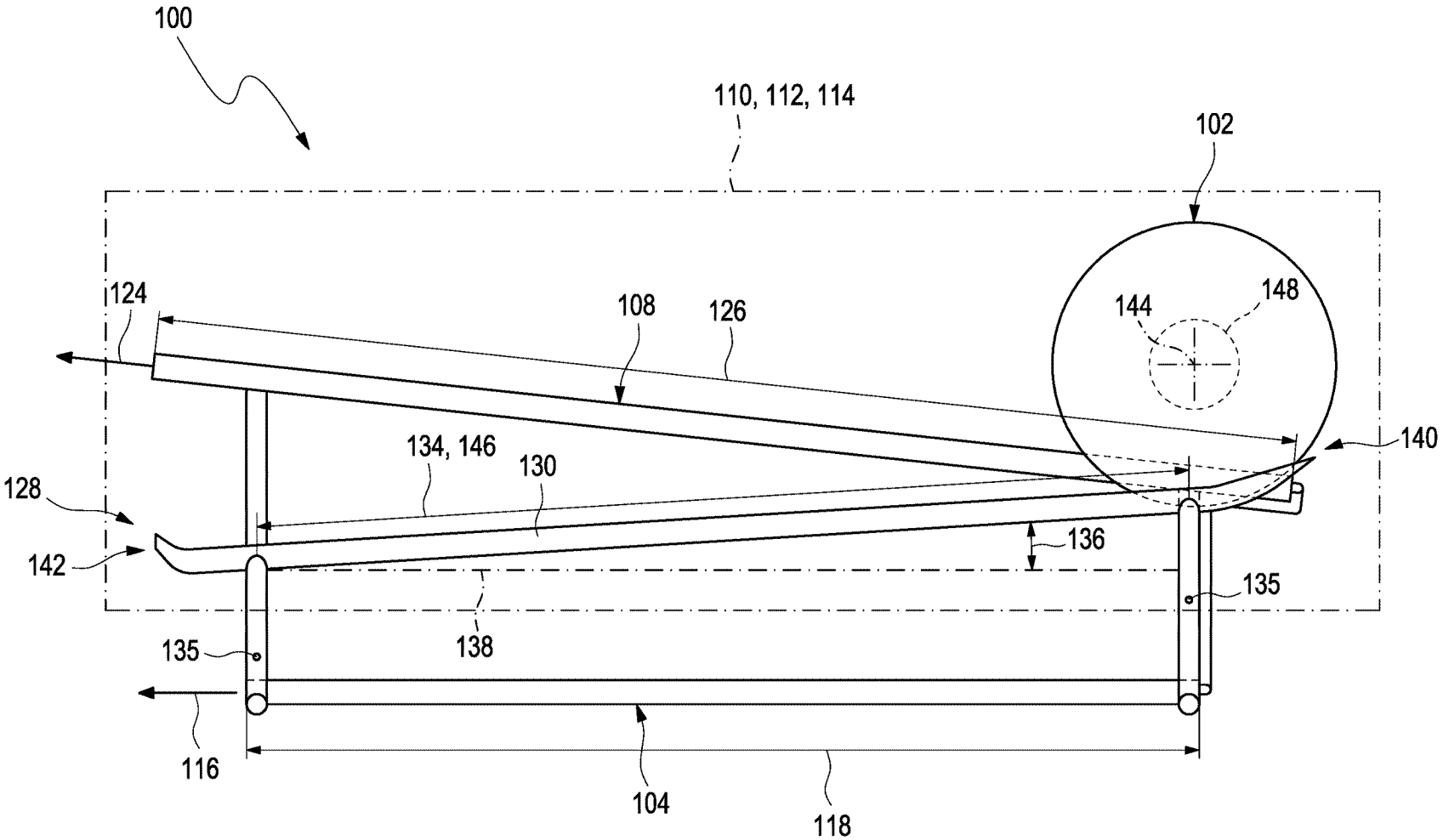

In the Figures:

FIG. 1 shows a perspective view of an apparatus for electrostatically discharging a packaging container made of plastics; and FIG. 2 shows a side view of the apparatus.

DETAILED DESCRIPTION OF THE EMBODIMENTS

FIG. 1 shows an apparatus 100 for electrostatically discharging a primary packaging container 102 (FIG. 2) made of plastics. For example, the primary packaging container 102 may be a bottle comprising a volume of two liters, wherein the bottle is made of fluorinated ethylene propylene. The apparatus 100 comprises at least one electrode 104. The electrode 104 is adapted to generate ionized air in the vicinity of the electrode 104. The electrode 104 may be a discharging electrode commercially available under the product name R50 or R51 from the company Eltex-Elektrostatik-GmbH, Blauenstraβe 67-69, 79576 Weil am Rhein, Germany. The apparatus 100 may comprise a plurality of electrodes 104, 106, 108. According to the embodiment shown in FIG. 1, the apparatus 100 comprises a first electrode 104, a second electrode 106 and a third electrode 108. Each of the electrodes 104, 106, 108 is adapted to generate ionized air in the vicinity thereof. It is to be noted that the terms "first", "second" and "third" are not intended to provide a specific meaning or order of importance but are merely intended to allow to differentiate between the respective electrodes.

The electrodes 104, 106, 108 are located within planes 110, 112, 114 which are parallel to one another. Particularly, the planes 110, 112, 114 are evenly spaced apart from one another. The first electrode 104 comprises a first longitudinal direction 116, which is a direction parallel to a first predetermined length 118 thereof. The second electrode 106 comprises a second longitudinal direction 120, which is a direction parallel to a second predetermined length 122 thereof. The third electrode 108 comprises a third longitudinal direction 124, which is a direction parallel to a third predetermined length 126 thereof. With other words, each of the electrodes 104, 106, 108 is rod shaped. Thus, the lengths 118, 122, 126 of the electrodes 104, 106, 108 are significantly greater than a width and/or height thereof. It is to be noted that at least the first predetermined length 118 and the second predetermined length 122 are of equal size or dimension. The first predetermined length 118 corresponds to at least a circumference of the primary packaging container 102. The first predetermined length 118 is determined based on the diameter and the circumference, respectively of the primary packaging container 102. In other words, a larger primary packaging container 102 usually comprises a larger diameter and, therefore, a larger circumference. Accordingly, a larger primary packaging container 102 having a larger circumference requires the first predetermined length 118 to be larger in order to allow the primary packaging container 102 to be rotated a complete circumference in the vicinity of the at least one electrode 104. In the present embodiment, it is preferred to design the first predetermined length 118 to correspond to the dimension of at least one circumference of the largest primary packaging container 102 intended to be used with the apparatus 100.

Optionally, at least one of the plurality of electrodes 104, 106, 108 is inclined relative to the other electrodes as shown in FIG. 1. In other words, while the first predetermined length 118, the second predetermined length 122 and the third predetermined length 126 may be identically, the longitudinal direction 116, 120, 124 of one of the electrodes 104, 106, 108 may deviate from the other longitudinal directions 116, 120, 124 within the planes 110, 112, 114. As shown in FIG. 1, the first longitudinal direction 116 of the first electrode 104 and the second longitudinal direction 120 of the second electrode 106 are parallel to one another whereas the third longitudinal direction 124 is inclined thereto. With respect to the illustration of FIG. 1, the third electrode 108 is the rearmost electrode.

The apparatus 100 further comprises a moving path 128 for moving the primary packaging container 102 to be electrostatically discharged. The moving path 128 is formed such that the primary packaging container 102 is adapted to pass the at least one electrode 104 and to be rotated in the vicinity thereof so as to be contacted by the ionized air as will be explained in further detail below. In other words, the moving path 128 is formed such that the primary packaging container 102 may pass the at least one electrode 104 and may be rotated in the vicinity thereof so as to be contacted by the ionized air. According to the embodiment shown in FIG. 1, the moving path 128 is formed such that the primary packaging container 102 is adapted to pass each of the electrodes 104, 106, 108 and to be rotated in the vicinity thereof so as to be contacted by the ionized air. The moving path 128 comprises rails 130 on which the primary packaging container 102 is movable. The rails 130 are arranged with a predetermined distance 132 to the at least one electrode 104. In case there is only one electrode 104, the rails 130 are arranged such that the electrode 104 is in the middle between and below the rails 130. In the present embodiment, the predetermined distance 132 is defined between the electrodes 104, 106, 108 and the rails 130 adjacent to or next to the respective electrode 104, 106, 108. The distance 132 may be in a range from 1 cm to 25 cm, preferably from 2 cm to 20 cm, and more preferably from 3 cm to 17 cm such as 9 cm.

The rails 130 comprise a portion 134 which is arranged with a constant distance 132 to the at least one electrode 104 over the length 118 of the electrode 104. In the present embodiment, only the distance 132 between the first electrode 104 and the portion 134 of the rails 130 and the distance 132 between the second electrode 106 and the portion 134 of the rails 130 are constant. The distance 132 may be variable. The rails 130 may be manually moved. For example, the rails 130 may be arranged on a supporting structure such as a frame which comprises an adjusting mechanism 135 for adjusting the position of the rails 130. The adjustment of the positions of the rails 130 comprises both an adjustment of the distance 132 of the rails 130 relative to the electrodes 104, 106 and an adjustment of the rails 130 relative to one another. The adjusting mechanism 135 may comprise tubes of the frame which may be moved relative to one another such that one of the tubes may be moved into and out of the other tube and a fixing means such as screw for fixing the tubes in their position. Alternatively, the rails 130 may be moved by means of an actuator (not shown in detail). Even in this case, the rails 130 are moved such that the above distance 132 to the portion 134 will be constant over the length of the at least one electrode 104. Needless to say, the first electrode 104 and the second electrode 106 may also be moved in a similar manner. It is to be noted that the portion 134 of the rails 130 is parallel to the first and second longitudinal directions 116, 120 of the first electrode 104 and the second electrode 106. A movement of the rails 130 allows an adaption of the moving path 128 to the respective size and/or height of the primary packaging container 102 to be discharged. By means of a variation of the distance 132, the respective size or amount of air which is ionized in the vicinity of the first electrode 104 and the second electrode 106 may be adjusted.

Further, the moving path 128 comprises an inclination 136. In other words, a portion of the moving path 128 is inclined with respect to a plane 138 perpendicular to the direction of gravity. For example, the portion 134 of the rails 130 is inclined with respect to the plane 138 perpendicular to the direction of gravity. The inclination may be an angle of 20°. More particularly, the moving path 128 comprises a start portion 140, at which a primary packaging container 102 to be discharged is disposable before being discharged, and an end portion 142 at which the primary packaging container 102 is removable after being discharged. The start portion 140 is arranged higher than the end portion 142 with respect to the direction of gravity. With respect to the illustration of FIG. 1, the start portion 140 is arranged at the right and the end portion 142 is arranged at the left. In any case, the at least one electrode 104 is parallel to the portion 134. As shown in FIG. 1, the first electrode 104 and the second electrode 106 are inclined so as to be parallel to the portion 134 of the rails 130. Due to the inclination 136, the moving path 128 is formed such that the primary packaging container 102 is moveable by means of gravity.

FIG. 2 shows a side view of the apparatus 100 with the primary packaging container 102 arranged on the moving path 128. More particularly, the primary, packaging container 102 is disposed at the start portion 140. The primary packaging container 102 comprises a longitudinal axis 144. The moving path 128 is formed such that the primary packaging container 102 is rotatable at least one complete rotation around the longitudinal axis 144 in the portion 134 of the rails 130. For example, the moving path 128 is formed such that the primary packaging container 102 is rotatable 1.5 rotations around the longitudinal axis 144 in the portion 134 of the rails 130. Accordingly, the portion 134 of the rails 130 comprises a length 146 corresponding to at least a circumference of the primary packaging container 102. The length 146 is determined based on the diameter and the circumference, respectively of the primary packaging container 102. In other words, a larger primary packaging container 102 usually comprises a larger diameter and, therefore, a larger circumference. Accordingly, a larger primary packaging container 102 having a larger circumference requires the length 146 to be larger in order to allow the primary packaging container 102 to be rotated a complete circumference around its longitudinal axis 144 in the portion 134 of the rails 130. In the present embodiment, it is preferred to design the length 146 to correspond to the dimension of at least one circumference of the largest primary packaging container 102 intended to be used with the apparatus 100. As already mentioned, the moving path 128 comprises the inclination 136 such that the primary packaging container 102 is allowed to be rotated when moving in the portion 134 caused by gravity.

Further, at least one of the electrodes 104, 106, 108 is arranged such that the primary packaging container 102 is adapted to pass the one electrode 104, 106, 108 with a complete cross-section area perpendicular to the longitudinal axis 144 of the primary packaging container 102. As mentioned above, the third electrode 108 is arranged inclined with respect to the moving path 128 and the first electrode 104 and the second electrode 106 as shown in FIG. 2. Needless to say, the inclination of the third electrode 108 may be varied. For example, the inclination of the third electrode 108 may be adapted to the size or diameter of the primary packaging container 102. In other words, when the primary packaging container 102 moves from the start portion 140 to the end portion 142 while the third electrode 108 is operated, the cross-section of the primary packaging container 102 is intersected by the third electrode 108 if seen in a projection in a direction parallel to the longitudinal axis 144 of the primary packaging container 102. Thus, a bottom and/or a top of the primary packaging container 102 may be discharged. For example, the primary packaging container 102 may comprises a closure 148. The moving path 128 is formed such that the primary packaging container 102 is moveable such that the closure 148 faces the third electrode 108. Thereby, the primary packaging container 102 may be discharged at the closure 148 and the portions adjacent thereto when the primary packaging container 102 moves from the start portion 140 to the end portion 142 while the third electrode 108 is operated. It is explicitly mentioned that further electrodes may be present. For example, a fourth electrode (not shown in detail) may be located parallel to the third electrode 108 with the first electrode 104 and the second electrode 106 therebetween. Thus, a bottom and a top of the primary packaging container 102 may be discharged. Needless to say, the inclination of the fourth electrode may be varied. For example, the inclination of the fourth electrode may be adapted to the size or diameter of the primary packaging container 102.

Hereinafter, a method for electrically discharging a primary packaging container 102 made of plastics will be described. For example, the primary packaging container 102 may be a bottle with a volume of two liters and may be made of fluorinated ethylene propylene. The primary packaging container 102 may be the one as described above. At the beginning, the primary packaging container 102 is arranged on the moving path 128 at the start portion 140. Particularly, the primary packaging container 102 is arranged on the moving path 128 such that the closure 148 faces the third electrode 108. Further, an alternating voltage is applied to the at least one electrode 104 such that the at least one electrode 104 generates ionized air in the vicinity thereof. In the present embodiment, an alternating voltage is applied to the first electrode 104, to the second electrode 106 and to the third electrode 108 such that the electrodes 106, 108, 110 generate ionized air in the vicinity thereof. For example, the amount of the alternating voltage may be in a range of 4 kV to 12 kV such as 8 kV. The frequency of the alternating voltage may be 50 Hz.

Then, the primary packaging container 102 is allowed to move towards the end portion 142. For example, the primary packaging container 102 is released and is allowed to move towards the end portion 142 by means of gravity and due to the inclination 136. Thus, the primary packaging container 102 moves on the rails 130 by means of gravity. While moving, the primary packaging container 102 passes the at least one electrode 104. More particularly, in the present embodiment, the primary packaging container 102 passes the first electrode 104, the second electrode 106 and the third electrode 108 at the same time. This moving direction corresponds to a moving from the right to the left according to the illustration of FIG. 2. Further, while moving, the primary packaging container 102 is rotated in the vicinity of the electrodes 104, 106, 108 on the rails 130 in the portion 134 and contacted by the ionized air. Due to the specific arrangement of the moving path 128 and the electrodes 104, 106, 108, the primary packaging container 102 is moved so as to pass the at least one electrode 104 with the predetermined distance 132 to the at least one electrode 104. In the present embodiment, the primary packaging container 102 is moved so as to pass the first electrode 104 and the second electrode 106 with the predetermined distance 132 to the first electrode 104 and the second electrode 106. Particularly, the moving path 128 is formed such that the primary packaging container 102 is rotated at least one complete rotation around the longitudinal axis 144 in the vicinity of the electrodes 104, 106, 108, while being contacted by the ionized air. For example, the primary packaging container 102 fulfills 1.5 rotations around the longitudinal axis 144 when moving on the moving path 128. Thus, it is ensured that at least the complete outer circumferential surface of the primary packaging container 102 is electrostatically discharged. Additionally, the inner circumferential surface of the primary packaging container 102 is electrostatically discharged.

Further, the primary packaging container 102 is moved parallel to the first longitudinal direction 116 of the first electrode 104. It is to be noted that in the present embodiment, the primary packaging container 102 is also moved parallel to the second longitudinal direction 120 of the second electrode 106 as the first longitudinal direction 116 and the second longitudinal direction 120 are parallel to one another. As described above, the third electrode 108 is arranged inclined with respect to the first electrode 104 and the second electrode 106. Thus, during moving on the moving path 128, the primary packaging container 102 passes this one electrode 108 with a complete cross-sectional area perpendicular to the longitudinal axis 144 of the primary packaging container 102. In other words, when the primary packaging container 102 moves from the start portion 140 to the end portion 142 while the third electrode 108 is operated, the cross-section of the primary packaging container 102 is intersected by the third electrode 108 if seen in a projection in a direction parallel to the longitudinal axis 144 of the primary packaging container 102. As mentioned above, the primary packaging container 102 comprises the closure 148. The primary packaging container 102 is arranged on the moving path 128 such that the closure 148 faces the third electrode 108. When the primary packaging container 102 moves from the start portion 140 to the end portion 142, the primary packaging container 102 is discharged at the closure 148 and the portions adjacent thereto while the third electrode 108 is operated. Thus, not only the outer circumferential surface and the inner circumferential surface, if applicable, of the primary packaging container 102 is electrostatically discharged by means of the first electrode 104 and the second electrode 106 but the top side of the primary packaging container 102 is electrostatically discharged by means of the third electrode 108. Accordingly, essential portions of the primary packaging container 102 may be effectively electrostatically discharged by means of the apparatus 100 and the method according to the present invention. More particularly, the electrostatical charge of the primary packaging container 102 may be reduced below −200 V such that particles do not adhere thereto.

Hereinafter, a table is given which indicates measurement results of voltage after the apparatus 100 has electrostatically discharged primary packaging containers 102. It is to be noted that the primary packaging container 102 have been electrostatically charged to a voltage of −25 kV before using the apparatus 100 in order to electrostatically charge the primary packaging containers 102 to a significant amount. The primary packaging containers 102 used for the measurements were bottles comprising a volume of two liters, wherein the bottles are made of fluorinated ethylene propylene. The measurement points at the primary packaging containers 102 were evenly distributed along the height and the circumferential direction of the bottles. More particularly, there were totally 12 measurement points, wherein three measurement points are evenly distributed over the height of the bottle and four measurement points are evenly distributed along the circumferential direction around the longitudinal axis. In other words, there were four measurement points in each of three parallel planes perpendicular to the longitudinal axis 144 and evenly distributed over the height of the bottle. Thus, the planes are evenly spaced apart from one another as well as to the bottom and the top of the bottle. The measurement points within each of the planes are indicated as front, right, left and rear which are imaginary measurement points if a bottle is disposed in front of an observer with the bottom oriented downwards and the top oriented upwards. Three measurement points are associated with each of the four measurement points mentioned before and indicated as top, middle and bottom. Still further, two additional measurement points are indicated which were located below the bottom and above the top of the bottle in order to measure the voltage at the bottom and at the bottle neck. These two measurement points are indicated as below bottom and above top. The number of the primary packaging containers 102 is indicated in the first column from the left. The total number of primary packaging containers 102 was 13. It is to be noted that the primary packaging containers 102 numbers 1 to 13 have been electrostatically discharged while the first to third electrodes 104, 106, 108 have been operated. Regarding the primary packaging containers 102 numbers 7 to 13, these have been removed from the apparatus 100 after having been electrostatically discharged such that the bottom thereof faces the first electrode 104 and the second electrode 106 for a short period. The respective measurement results are given as a positive voltage even though the voltage is actually negative. For example, concerning primary packaging container 102 having number 1, a voltage of 36 V is given for the measurement point front and top even though the actual voltage is −36 V.

TABLE 1

| | front | | | right | | | rear | | | left | | | above | below |
|---|---|---|---|---|---|---|---|---|---|---|---|---|---|---|
| No. | top | middle | bottom | top | middle | bottom | top | middle | bottom | top | middle | bottom | top | bottom |
| 1 | 36 | 40 | 60 | 30 | 7 | 9 | 59 | 26 | 28 | 22 | 12 | 13 | 78 | 220 |
| 2 | 48 | 14 | 47 | 6 | 35 | 0 | 4 | 20 | 13 | 6 | 7 | 51 | 110 | 240 |
| 3 | 92 | 32 | 22 | 30 | 48 | 8 | 0 | 0 | 9 | 101 | 83 | 87 | 133 | 561 |
| 4 | 0 | 14 | 15 | 0 | 20 | 38 | 90 | 0 | 45 | 21 | 0 | 0 | 120 | 230 |

TABLE 1-continued

| | front | | | right | | | rear | | | left | | | above | below |
|---|---|---|---|---|---|---|---|---|---|---|---|---|---|---|
| No. | top | middle | bottom | top | middle | bottom | top | middle | bottom | top | middle | bottom | top | bottom |
| 5 | 180 | 35 | 140 | 29 | 12 | 45 | 13 | 2 | 0 | 6 | 13 | 15 | 140 | 606 |
| 6 | 15 | 6 | 80 | 14 | 20 | 7 | 0 | 14 | 7 | 17 | 130 | 140 | 150 | 570 |
| 7 | 30 | 17 | 30 | 24 | 18 | 78 | 15 | 19 | 76 | 3 | 35 | 66 | 130 | 200 |
| 8 | 22 | 17 | 22 | 15 | 8 | 12 | 0 | 18 | 0 | 0 | 24 | 0 | 88 | 220 |
| 9 | 10 | 15 | 0 | 19 | 13 | 48 | 90 | 15 | 22 | 80 | 2 | 0 | 157 | 85 |
| 10 | 21 | 17 | 3 | 0 | 9 | 43 | 66 | 33 | 70 | 100 | 5 | 7 | 150 | 101 |
| 11 | 27 | 6 | 8 | 14 | 3 | 8 | 0 | 0 | 15 | 47 | 11 | 19 | 210 | 146 |
| 12 | 0 | 23 | 79 | 91 | 0 | 38 | 23 | 58 | 0 | 19 | 40 | 36 | 110 | 147 |
| 13 | 0 | 0 | 8 | 8 | 10 | 11 | 40 | 10 | 10 | 0 | 39 | 17 | 139 | 174 |

As can be taken from the table, the apparatus is suitable to electrostatically discharge the primary packaging containers 102 at each height of the measurement points front, right, rear and left to an amount significantly less than −200 V. As can be further taken, operation of the third electrode 108 allows to ensure that the bottom is electrostatically discharged to an amount of approximately −200 V and less.

LIST OF REFERENCE NUMBERS

100 apparatus
102 primary packaging container
104 first electrode
106 second electrode
108 third electrode
110 plane
112 plane
114 plane
116 first longitudinal direction
118 first predetermined length
120 second longitudinal direction
122 second predetermined length
124 third predetermined direction
126 third longitudinal length
128 moving path
130 rails
132 distance
134 portion
135 adjusting mechanism
136 inclination
138 plane
140 start portion
142 end portion
144 longitudinal axis
146 length
148 closure

The invention claimed is:

1. A method for electrostatically discharging a primary packaging container (102) made of plastics, comprising moving a primary packaging container (102) to be electrostatically discharged so as to pass at least one electrode (104, 106, 108), applying an alternating voltage to the electrode (104, 106, 108) so as to generate ionized air in a vicinity of the electrode (104, 106, 108), and rotating the primary packaging container (102) in the vicinity of the electrode (104, 106, 108) so as to be contacted by the ionized air, wherein the primary packaging container (102) is moved so as to pass a plurality of electrodes (104, 106, 108), wherein to each of the plurality of the electrodes (104, 106, 108) an alternating voltage is applied so as to generate ionized air in the vicinity of the plurality of electrodes (104, 106, 108), wherein the primary packaging container (102) is moved so as to pass the plurality of electrodes (104, 106, 108) with a predetermined distance (132) to the electrodes (104, 106, 108), wherein the electrodes (104, 106, 108) comprise a predetermined length (118, 122, 126), wherein the predetermined distance (132) to at least one of the electrodes (104, 106, 108) is constant over the predetermined length (118, 122, 126).

2. The method according to claim 1, wherein the electrode (104, 106, 108) extends in a longitudinal direction (116, 120, 124), wherein the primary packaging container (102) is moved parallel to the longitudinal direction (116, 120, 124).

3. The method according to claim 1, wherein the primary packaging container (102) comprises a longitudinal axis (144), wherein the primary packaging (102) container is rotated at least one complete rotation around the longitudinal axis (144) in the vicinity of the electrodes (104, 106, 108) while being contacted by the ionized air.

4. The method according to claim 1, wherein the electrodes (104, 106, 108) are located within planes (110, 112, 114) which are parallel to one another.

5. The method according to claim 3, wherein the electrodes (104, 106, 108) are located within planes (110, 112, 114) which are parallel to one another.

6. The method according to claim 4, wherein the planes (110, 112, 114) are evenly spaced apart from one another.

7. The method according to claim 5, wherein the planes (110, 112, 114) are evenly spaced apart from one another.

8. The method according to claim 3, wherein at least one of the electrodes (104, 106, 108) is arranged such that the primary packaging container (102) passes the at least one electrode (104, 106, 108) with a complete cross-sectional area perpendicular to the longitudinal axis (144) of the primary packaging container (102).

9. The method according to claim 5, wherein at least one of the electrodes (104, 106, 108) is arranged such that the primary packaging container (102) passes the at least one electrode (104, 106, 108) with a complete cross-sectional area perpendicular to the longitudinal axis (144) of the primary packaging container (102).

10. The method according to claim 7, wherein at least one of the electrodes (104, 106, 108) is arranged such that the primary packaging container (102) passes the at least one electrode (104, 106, 108) with a complete cross-sectional area perpendicular to the longitudinal axis (144) of the primary packaging container (102).

11. The method according to claim 8, wherein the primary packaging container (102) comprises a closure (148), wherein the primary packaging container (102) is moved such that the closure (148) faces the one electrode (104, 106, 108).

12. The method according to claim 9, wherein the primary packaging container (102) comprises a closure (148), wherein the primary packaging container (102) is moved such that the closure (148) faces the one electrode (104, 106, 108).

13. The method according to claim 10, wherein the primary packaging container (102) comprises a closure (148), wherein the primary packaging container (102) is moved such that the closure (148) faces the one electrode (104, 106, 108).

14. The method according to claim 1, wherein the primary packaging container (102) is moved along an inclined path (128).

15. The method according to claim 1, wherein the primary packaging container (102) is moved by means of gravity.

16. The method according to claim 1, wherein the primary packaging container (102) is made of fluorinated ethylene propylene.

17. An apparatus (100) for electrostatically discharging a primary packaging container (102) made of plastics, comprising at least one electrode (104, 106, 108) adapted to generate ionized air in a vicinity of the electrode (104, 106, 108) and a moving path (128) for moving a primary packaging container (102) to be electrostatically discharged, wherein the moving path (128) is formed such that the primary packaging container (102) is adapted to pass the electrode (104, 106, 108) and to be rotated in the vicinity of the electrode (104, 106, 108) so as to be contacted by the ionized air, wherein the apparatus (100) further comprises a plurality of electrodes (104, 106, 108), wherein each of the plurality of electrodes (104, 106, 108) is adapted to generate ionized air, wherein the moving path (128) is formed such that the primary packaging container (102) is adapted to pass each of the electrodes (104, 106, 108) and to be rotated in the vicinity of the electrodes (104, 106, 108), wherein the moving path (128) comprises rails (130) on which the primary packaging container (102) is moveable, wherein the rails (130) are arranged with a predetermined distance (132) to the electrode (104, 106, 108), wherein the rails (130) comprise a portion (134) which is arranged with a constant distance (132) to the electrode (104, 106, 108) over a length (118, 122, 126) of the electrode (104, 106, 108).

18. The apparatus (100) according to claim 17, wherein the moving path (128) is formed such that the primary packaging container (102) is moveable by means of gravity.

* * * * *